US005263448A

United States Patent [19]

Bluhm et al.

[11] Patent Number: 5,263,448

[45] Date of Patent: Nov. 23, 1993

[54] METHOD OF MONITORING AND ADJUSTMENT SYSTEM FOR THE ACTUATION OF AN ADJUSTMENT MEMBER OF A CONTROL OF AN INTERNAL COMBUSTION MACHINE

[75] Inventors: Klaus Bluhm, Steinbach/Ts; Manfred Pfalzgraf, Frankfurt, both of Fed. Rep. of Germany

[73] Assignee: VDO Adolf Schindling AG, Frankfurt am Main, Fed. Rep. of Germany

[21] Appl. No.: 866,322

[22] Filed: Apr. 9, 1992

[30] Foreign Application Priority Data

Jul. 24, 1991 [DE] Fed. Rep. of Germany ..... 4124515

[51] Int. Cl.[5] ..... F02D 11/10

[52] U.S. Cl. ..... 123/396; 123/399; 73/118.1

[58] Field of Search ..... 123/399, 396, 397; 73/118.1

[56] References Cited

U.S. PATENT DOCUMENTS

| | | | |
|---|---|---|---|
| 3,602,044 | 8/1971 | Markey | 73/132 |
| 4,505,357 | 3/1985 | Pfalzgraf et al. | 123/397 |
| 4,640,248 | 2/1987 | Stoltman | 123/399 |
| 4,881,502 | 11/1989 | Kabasin | 123/399 |
| 4,920,939 | 5/1990 | Gale | 123/399 |
| 4,970,486 | 11/1990 | Gray et al. | 338/2 |
| 5,150,681 | 9/1992 | Kull et al. | 123/399 |

FOREIGN PATENT DOCUMENTS

| | | |
|---|---|---|
| 0322785 | 7/1989 | European Pat. Off. . |
| 0355967 | 2/1990 | European Pat. Off. . |
| 0449424 | 10/1991 | European Pat. Off. . |
| 3913609 | 11/1989 | Fed. Rep. of Germany . |

*Primary Examiner*—Andrew M. Dolinar
*Attorney, Agent, or Firm*—Martin A. Farber

[57] ABSTRACT

A displacement device (1) for the actuation of a displacement member (4) of a control of an internal combustion engine is disclosed having an accelerator pedal (2) and a linkage (3) which forms a mechanical connection between pedal and adjustment member, the pedal (2) and the linkage (3) together forming a force-transmission path. In such a displacement device, the plausibility verification for the relationship between the position of the pedal (2) and the position of the adjustment member (4) is to be improved. For this purpose, a force sensor (8) is arranged within the force transmission path. A memory (15) stores relationships of force to displacement of the linkage. A signal processor 10 uses data of the memory to direct a motor (13) to correct a position of a throttle valve (12) to provide a desired amount of fuel to an engine in event of a failure of the linkage.

5 Claims, 1 Drawing Sheet

METHOD OF MONITORING AND ADJUSTMENT SYSTEM FOR THE ACTUATION OF AN ADJUSTMENT MEMBER OF A CONTROL OF AN INTERNAL COMBUSTION MACHINE

FIELD AND BACKGROUND OF THE INVENTION

The present invention relates to a method of monitoring the actuation of an adjustment member of a control of an internal combustion engine, as for a motor vehicle, wherein the adjustment member is moved against a restoring force, and to an adjustment arrangement for the actuation of an adjustment member of a control of an internal combustion engine having a manipulator, such as an accelerator pedal, and having a linkage forming a mechanical connection between manipulator and adjustment member, which together form a force-transmission path.

In automotive vehicles, the engine as a rule is not located in the direct vicinity of the driver. When the driver wishes to accelerate the vehicle, or brake the vehicle with the aid of the engine, he must change the output of the engine. This is done, for instance, via a throttle-valve adjustment. Since the driver cannot directly operate the throttle valve or other adjustment elements such as, for instance, an injection pump, the adjustment, as a rule, is effected via a system of rods or a Bowden cable, or a combination thereof. An adjustment member is arranged on one end thereof while a manipulator which can be actuated by the driver, generally an accelerative pedal or a gas lever, is arranged at the other end. The force exerted by the driver on the manipulator is then transmitted to the adjustment member by the mechanical connection formed by the system of rods and/or the Bowden cable, as a result of which the adjustment member is displaced. In modern automotive vehicles the adjustment member no longer acts on the internal combustion engine directly but rather via the interposition of electro-mechanical or pneumatic setting members.

With the introduction of these setting members, it became necessary to effect monitorings and plausibility verifications. For example, electric signals for the control of the setting member are monitored for plausibility. In one special example, a switch is arranged on the accelerator pedal, the switch being closed when the driver actuates the accelerator pedal. Furthermore, a switch which opens when the setting member is moved out of its position of rest is provided on the setting member. If the setting member is now moved into a higher position, i.e. the setting-member switch opens, without the switch on the accelerator pedal being closed, it is to be assumed that something is wrong. In this case, the control will carry out an emergency program. The error control is in this case limited to the position of rest of the accelerator pedal.

SUMMARY OF THE INVENTION

It is an object of the invention to obtain more information for the monitoring and control of the engine.

According to the method of the invention, the force required in order to move the adjustment member is measured.

Since the force required for the displacement of the adjustment member is known, by monitoring the actual force applied, information can be obtained as to whether the adjustment member is operating properly or not. If, for instance, the force necessary to move the adjustment member is less than a desired value, this is an indication that the restoring force has declined. If the force required is greater than it should be, this is an indication that the adjustment member or the linkage is too sluggish. In this case, the monitoring is not limited to one of the two end positions of the adjustment member. Rather, the force can be monitored continuously over the entire path of movement of the adjustment member.

In a preferred embodiment in which the force is transmitted via a force transmission path, the force is measured in the region of the introduction at the start of the force transmission path. This has the advantage that the force transmission path is also included in the monitoring. Sluggishness in the force transmission path will be immediately recognized. A break in the force transmission path resulting in the fact that practically no force can be transmitted any longer can also be detected.

In addition to the force, the movement of the adjustment member is advantageously also measured, and the measured actual relationship is compared with a predetermined desired relationship. An error routine is carried out when the actual relationship does not agree with the desired relationship, or does not lie within a predetermined tolerance range around the desired relationship. This embodiment is particularly of advantage when the restoring force is path-dependent, as in the case of a spring. With increasing deflection of the adjustment member, the force required to move the adjustment member becomes greater. If the increase in force does not correspond to what has been stipulated, i.e., the force fails to increase to the extent that it should, or the force increases to an extent greater than it should, this indicates that an error is present. One can then produce, for instance, a warning in the error routine or, if the error should be more serious, place an emergency travel program into effect.

Further according to the invention, an adjustment device of the aforementioned type is provided wherein a force sensor (8) is arranged within the course of the force transmission path (pedal 2, and rod linkage 3).

The force sensor measures the force which is introduced into the force transmission path by the driver via the manipulator. If this force, for instance, suddenly rises very rapidly, one can obtain the information from this that the driver wants a rapid increase in output of the engine. On the other hand, by continuous monitoring of the force flowing through the force transmission path, it can be determined whether the forces are changing on the average over the course of time. This would be an indication that the linkage or the adjustment member have become more sluggish. One can then produce a warning so that errors which occur can be eliminated at an early moment without extensive damage resulting.

In a preferred embodiment, the manipulator is developed as accelerator pedal (2) and the force sensor (8) is arranged in the accelerator pedal. By the arrangement of the force sensor in the accelerator pedal, assurance is had that the force applied by the driver is measured. There is obtained in this way an unequivocal indication that the force detected is applied by the driver. With this construction, therefore, the entire force transmission path can be reliably monitored. There is practically no region of the force transmission path which is not monitored by the force sensor.

In this connection, it is preferred that the accelerator pedal (2) have an actuation surface (9) and that the force sensor (8) be arranged below the actuation surface (9). The actuation surface is the place on the accelerator pedal on which the force of the driver acts directly. It is furthermore, as a rule, relatively flat so that the application of a force sensor is greatly facilitated.

The force sensor (8) is preferably developed as a strain-gauge sensor or a piezoelectric sensor. Both sensors directly supply electric signals which can be easily transmitted and evaluated.

In one particularly advantageous embodiment, the adjustment member (4) is acted on by a path-dependent opposing force, a distance sensor (potentiometer 11) being provided for the adjustment member (4). The force sensor (8) and the distance sensor (11) are connected to a processing device (10) which forms an "actual" relationship from output signals of both sensors (8, 11) and verifies whether this "actual" relationship corresponds to a predetermined desired relationship. The path-dependent opposing force can, for instance, be produced by a simple spring. With increasing deflection of this spring, an increasing force is necessary. Since the relationship between force and deflection is known, it is possible, by the monitoring of this relationship, to determine whether any part of the force transmission path is jammed or sluggish. If, for instance, a higher force is necessary for the deflection of the adjustment member than would correspond to the position of the adjustment member, this is an indication that unintended forces are acting on the linkage within the transmission path. In this case, an error report can be produced.

The processing device (10) preferably has a memory (15) in which the desired relationship is stored as a field of characteristic curves (FIG. 4). The processing device can then compare the input values, and therefore the actual relationship, with the desired values very rapidly and without extensive computation work.

Plural springs (5, 6) are preferably provided in order to produce the opposing force. This, on the one hand, increases the reliability since, even in the event of the failure of a spring, there is assurance that the adjustment member can still be returned to its zero or neutral position. This furthermore has the advantage in connection with the present invention that the breaking of a spring can be reliably noted. If a spring fails, it no longer acts as opposing force on the linkage. This is immediately detected by the force sensor and can be used by the processing device in order to introduce corresponding spring reactions.

The distance sensor (11) preferably produces at the same time a desired-value signal (SS) for the control. This desired value is dependent on the position of the adjustment member, for instance its deflection. Since the information on the position, however, is already present, this information can also be very easily used for the control.

In this connection, it is preferred that, if the distance sensor (11) is defective, the processing device (10) calculates the position of the adjustment member (4) from the output signal of the force sensor (8). The relationship between force and distance which is preestablished by the distance-dependent opposing force is known. If the distance sensor is defective and therefore can no longer give any information with regard to the position of the adjustment member, as well as with regard to the desired value, this position can be calculated backwards from the force measured by the force sensor. This can be attained even with relatively slight precision since the relationship between distance and force is subject to a certain tolerance. However, the information obtained is sufficient for emergency travel.

BRIEF DESCRIPTION OF THE DRAWING

With the above and other objects and advantages in view, the present invention will become more clearly understood in connection with the detailed description of the preferred embodiment, when considered with the accompanying drawings, of which.

DETAILED DESCRIPTION OF THE PREFERRED EMBODIMENT

Figure 1:
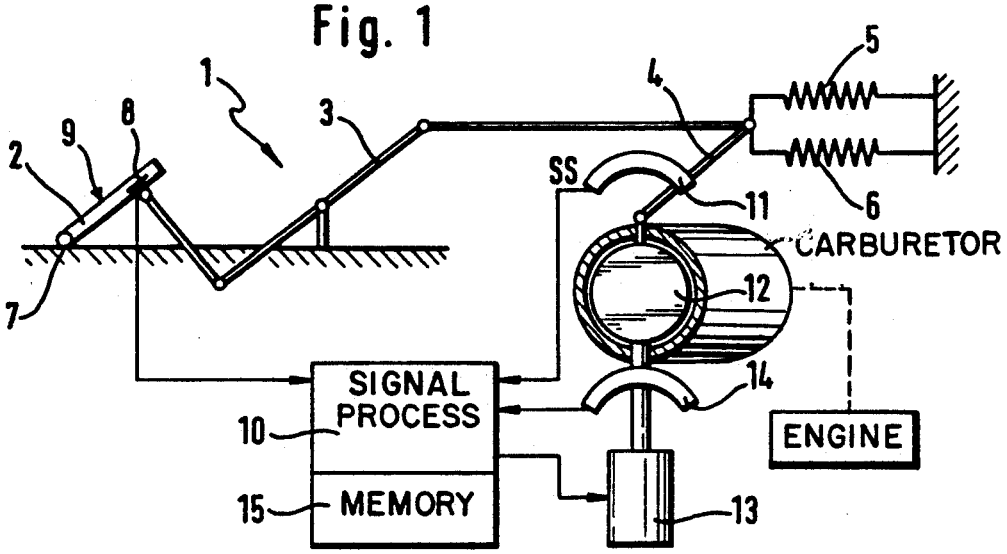
FIG. 1 is a diagrammatic view of an adjustment device.

An adjustment device 1 has an accelerator pedal 2 which is connected to an adjustment or actuating member 4 via a linkage developed as a system of rods 3. Instead of the rods 3 a pull cable or hydraulic connection between accelerator pedal 2 and actuating member 4 can be provided for the linkage if assurance is had that a force exerted on the accelerator pedal 2 leads to a displacement of the actuating member 4. A distance-dependent opposing force, produced by two springs 5, 6, acts on the actuating member 4. When the accelerator pedal is depressed in the direction of the floor 7, the actuating member 4 is moved to the left.

The accelerator pedal 2 has an actuation surface 9 below which a force sensor 8 is arranged. A force which acts on the actuating surface 9 is detected by the force sensor 8. Such a force can be produced, for instance, by the foot of the driver.

A processing device 10 is connected to the force sensor 8 and receives from it electric signals which contain information with regard to the force exerted on the actuating surface 9 of the accelerator pedal 2. The processing device 10 is furthermore connected to a potentiometer 11 having a wiper which is displaceable by the actuating member 4. The potentiometer 11 produces an electric signal which contains information as to the position of the actuating member 4. At the same time, the signal produced by the potentiometer 11 is a desired-value signal for the actuation of a throttle valve 12. The throttle valve 12 is part of a carburetor feeding a mixture of fuel and air to an engine, and is actuated by a motor 13. Its position is determined by a potentiometer 14, shown diagrammatically. After the setting, determined by the processing device 10, of the desired value on the potentiometer 11 by the actuating member 4, the motor 13 is placed in operation by the processing device 10 so as to displace the throttle valve 12 until the actual value tapped off from the potentiometer 14 agrees with the desired value predetermined on the potentiometer 11.

Figure 2:
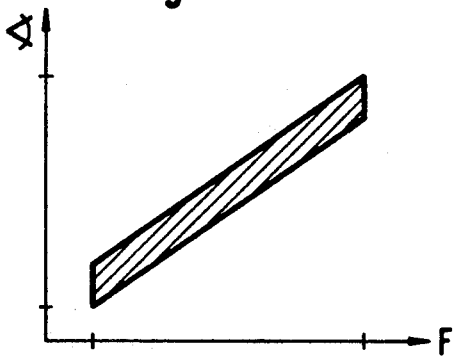
FIG. 2 is a graph showing the relationship between the deflection of an adjustment member and the force.

FIG. 2 shows in graphical form the relationship between the angle of deflection of the actuating member 4, or the distance covered by it, and the force which is necessary for this deflection. Although the relationship between force and distance should be linear in the case of a spring, in the present case a range has been indicated. On the one hand, the springs 5, 6 are subject to certain temperature influences while, on the other hand, further forces, in particular frictional forces, act within permissible limits on the system of rods 3. These forces may vary under different operating conditions, in particular changes in temperature. The greater the angle of deflection, the greater also the force F to be applied.

Figure 3:
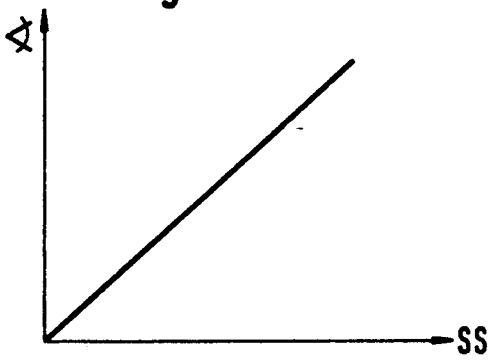
FIG. 3 is a graph showing the relationship between the desired value and the deflection.

FIG. 3 shows in graphical form the relationship between the deflection angle and a signal SS given off by the potentiometer 11. This relationship is linear in the present example. With increasing deflection of the actuating member 4, the signal SS increases. By a combination of the relationships shown in FIGS. 2 and 3, a family of characteristic curves shown in FIG. 4 can be determined, they representing the relationship between the force F and the desired value produced by the potentiometer 11. The desired value SS at the same time provides the information concerning the position of the actuating member 4.

Figure 4:
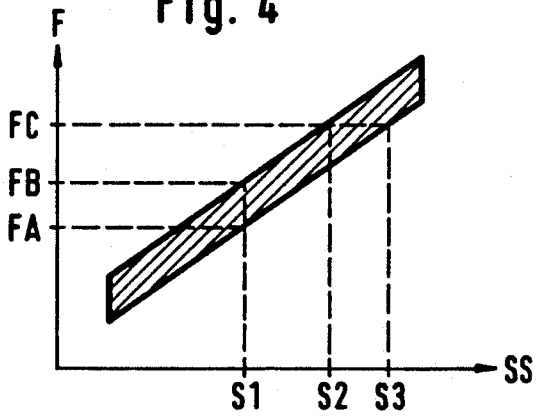
FIG. 4 is a graph showing the relationship between the force applied and the desired value.

As can be noted from FIG. 4, the force sensor 8 must, in the case of a desired-value signal SS of a value S1, measure a force of value between FA and FB. If the sensor 8 measures a greater force, this indicates that the system of rods 3 is too sluggish and therefore something is wrong in the system of rods, and if it measures a lower force this is an indication that one of the two springs 5, 6 is defective. In both cases, the processing device 10 can introduce a corresponding error reaction and therefore, for instance, produce a warning, or switch to emergency travel. The field of characteristic curves shown in FIG. 4 can be stored in a memory 15 which is connected to the processing device 10. As long as the relationship between desired value SS and force is limited to a quasi-linear relationship, it may also be sufficient to store the four corner points of the field of characteristic curves. However, since, as a rule, a nonlinear relationship is at least in part present, the storing of an entire family of characteristic curves is advisable.

If the potentiometer 11 gives off a signal which indicates that the actuating member 4 is in "full gas position", but the force sensor 8 indicates that no force is acting on the accelerator pedal, a defect is also present. The relationship between the output signal of the force sensor 8 and the output signal of the potentiometer 11 therefore also serves for plausibility verification.

If the potentiometer 11 fails, the motor would normally no longer be actuatable since a desired value cannot be established any longer. In this case, however, the output signal of the force sensor can be used within certain limits for emergency travel. In this case, the graph of FIG. 4 is used in the reverse direction. In such case there is preestablished a force FC with which there is then associated a desired value between the two limits S2 and S3, for instance their average value. The vehicle can then at least travel on its own to the nearest garage.

One can deviate in various respects from the embodiment shown. The rod system 3 can, for instance, be replaced by a Bowden cable or a hydraulic transmission. The two potentiometers 11 and 12 can be replaced by other distance-dependent or angle-dependent sensors. The relationship between the desired value and the displacement angle, or the displacement angle and the force need not be linear. The force sensor 8 can also be arranged at some other place of the system of rods 3, for instance at the transition point between the accelerator pedal 2 and the rods 3.

We claim:

1. An adjustment system for an actuation of an adjustment member of a control of an internal combustion engine, the control comprising:

a manipulator, an adjustment member, and a linkage forming a mechanical connection between the manipulator and the adjustment member, wherein the manipulator and the adjustment member and the linkage together constitute a force-transmission path;

a force sensor arranged within a course of the force transmission path, the adjustment member being acted on by a path-dependent opposing force;

a distance sensor mechanically coupled to the adjustment member and;

a processing device, the distance sensor and the force sensor being connected to the processing device allowing the processing device to establish an actual relationship between output signals of said distance and said force sensors, and to verify whether the actual relationship corresponds to a predetermined desired relationship; wherein the processing device includes a memory for storing the desired relationship as a field of characteristic curves.

2. A system according to claim 1, wherein distance sensor produces a desired-value signal for the processing device.

3. A system according to claim 2, wherein upon the occurrence of a defect in the distance sensor, the processing device calculates the position of the adjustment member based on an output signal of the force sensor.

4. A system for controlling a fuel intake control means of an internal combustion engine, comprising a manipulator;

an adjustment member at the fuel intake control means, the adjustment member being acted on by a path-depending opposing force;

a linkage forming a mechanical connection and a force transmitting path between the manipulator and the adjustment member;

a motor mechanically coupled to said fuel intake control means;

a processing device for operating the motor to set the fuel intake control means;

a first distance sensor mechanically coupled to the adjustment member;

a second distance sensor connected to said motor for signaling the processing device as to the motor position;

a force sensor sensing a force which is applied to the manipulator;

wherein the processing device includes a memory in which a relationship between the position of the adjustment member and the force applied to the manipulator under normal operating condition is stored, whereby the signals of the force sensor and the first distance sensor are transmitted to the processing device which uses that relationship to verify whether the actual force applied to the manipulator corresponds to the actual position of the adjustment member; and wherein the relationship is stored as a field of characteristic curves.

5. A system for controlling a fuel intake control means of an internal combustion engine, comprising a manipulator;

an adjustment member at the fuel intake control means, the adjustment member being acted on by a path-depending opposing force;

a linkage forming a mechanical connection and a force transmitting path between the manipulator and the adjustment member;

a motor mechanically coupled to said fuel intake control means;

a processing device for operating the motor to set the fuel intake control means;

a first distance sensor mechanically coupled to the adjustment member;

a second distance sensor connected to said motor for signaling the processing device as to the motor position;

a force sensor sensing a force which is applied to the manipulator;

wherein the processing device includes a memory in which a relationship between the position of the adjustment member and the force applied to the manipulator under normal operating condition is stored, whereby the signals of the force sensor and the first distance sensor are transmitted to the processing device which uses that relationship to verify whether the actual force applied to the manipulator corresponds to the actual position of the adjustment member; and wherein upon the occurrence of a defect in the first distance sensor, the processing device calculates the position of the adjustment member based on an output signal of the force sensor.

* * * * *